US011920319B2

(12) United States Patent
Mounsey et al.

(10) Patent No.: US 11,920,319 B2
(45) Date of Patent: Mar. 5, 2024

(54) DIPPER ASSEMBLY AND PARTS THEREOF

(71) Applicant: Mainetec Pty Ltd, Paget (AU)

(72) Inventors: Stephen John Mounsey, Paget (AU); Brett Ashley Hampson, Paget (AU)

(73) Assignee: Mainetec Pty Ltd, Paget (AU)

( * ) Notice: Subject to any disclaimer, the term of this patent is extended or adjusted under 35 U.S.C. 154(b) by 504 days.

(21) Appl. No.: 17/255,512

(22) PCT Filed: Jun. 26, 2018

(86) PCT No.: PCT/AU2018/050646
§ 371 (c)(1),
(2) Date: Dec. 23, 2020

(87) PCT Pub. No.: WO2020/000012
PCT Pub. Date: Jan. 2, 2020

(65) Prior Publication Data
US 2021/0372076 A1 Dec. 2, 2021

(51) Int. Cl.
*E02F 3/407* (2006.01)
*E02F 3/30* (2006.01)

(52) U.S. Cl.
CPC ..... *E02F 3/4075* (2013.01); *E02F 3/308* (2013.01)

(58) Field of Classification Search
CPC ..... E02F 3/407; E02F 3/4075; E02F 3/308; Y10T 292/1011; Y10T 292/0884; Y10T 292/1038
See application file for complete search history.

(56) References Cited

U.S. PATENT DOCUMENTS 1,307,747 A * 6/1919 Huber ..... E02F 7/06 414/722
1,383,102 A * 6/1921 Greuling ..... E02F 3/4075 292/171
1,391,114 A * 9/1921 Huber ..... E05B 65/0042 292/193
1,398,374 A * 11/1921 Gustus ..... E05B 65/005 292/193
1,944,949 A * 1/1934 Ratkowski ..... E02F 3/4075 414/726

(Continued)

FOREIGN PATENT DOCUMENTS

GB 679830 9/1952
JP H08310491 A * 11/1996

(Continued)

*Primary Examiner* — Jessica H Lutz
(74) *Attorney, Agent, or Firm* — Dentons Davis Brown PC; Matthew Warner-Blankenship

(57) ABSTRACT

A dipper assembly and parts thereof for use with a mining shovel includes: a dipper body having a back wall and an open dipper bottom; a dipper door pivotally coupled to the back wall of the dipper body and moveable between open and closed positions relative to the open dipper bottom; and a latch assembly for releasably securing the door in the closed position. The latch assembly includes a latch keeper and a latch member for engaging the latch keeper. The latch keeper is associated with the dipper body proximate the open dipper bottom and the latch member is coupled to the dipper door. The latch member includes at least one roller to assist the latch member in engaging and disengaging with the latch keeper and to reduce wear on the latch member.

17 Claims, 8 Drawing Sheets

(56) References Cited

U.S. PATENT DOCUMENTS

| | | | | | |
|---|---|---|---|---|---|
| 2,741,505 | A * | 4/1956 | Courney | E05B 63/246 292/79 |
| 3,738,513 | A * | 6/1973 | Wagner | E02F 3/407 37/901 |
| 5,815,958 | A * | 10/1998 | Olds | E02F 3/4075 37/444 |
| 9,915,053 | B2 * | 3/2018 | Gross | E21C 27/30 |
| 11,313,151 | B2 * | 4/2022 | Pfunder | E05B 17/22 |
| 2014/0079522 | A1 * | 3/2014 | Hren | E02F 3/308 292/306 |
| 2015/0159341 | A1 | 6/2015 | Gross et al. | |

FOREIGN PATENT DOCUMENTS

| | | | |
|---|---|---|---|
| JP | H09273364 | A * | 10/1997 |
| WO | 2014011651 | A2 | 1/2014 |

* cited by examiner

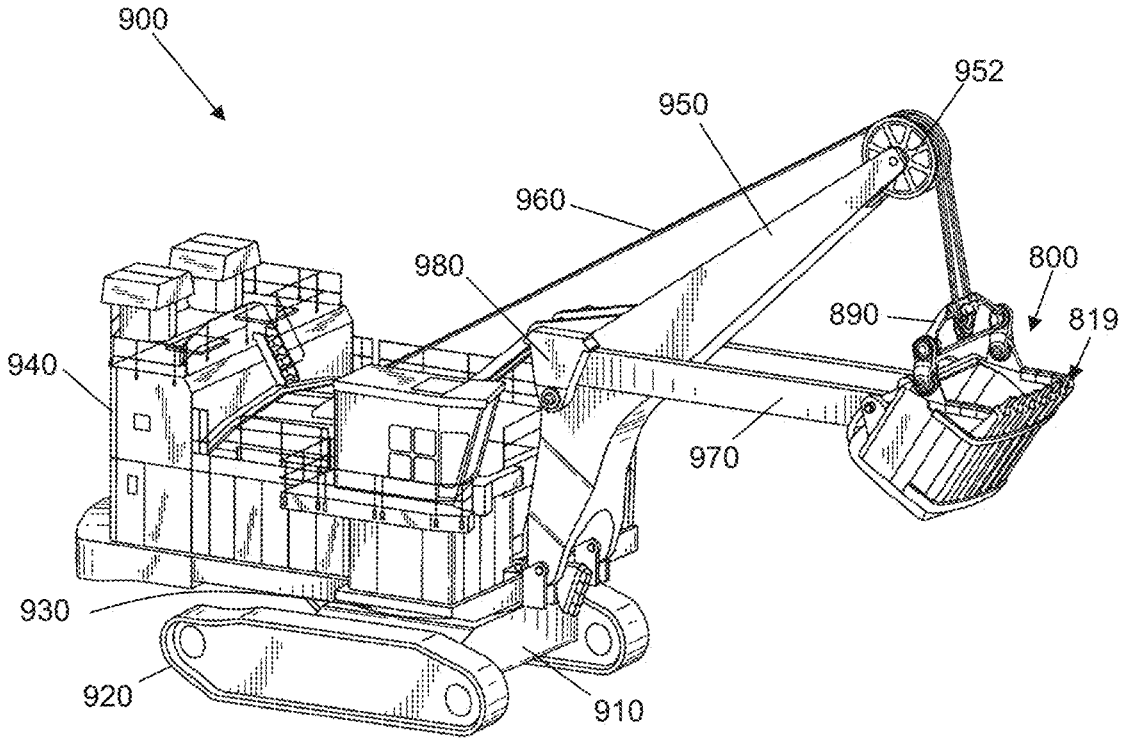
Figure 1 – Prior Art
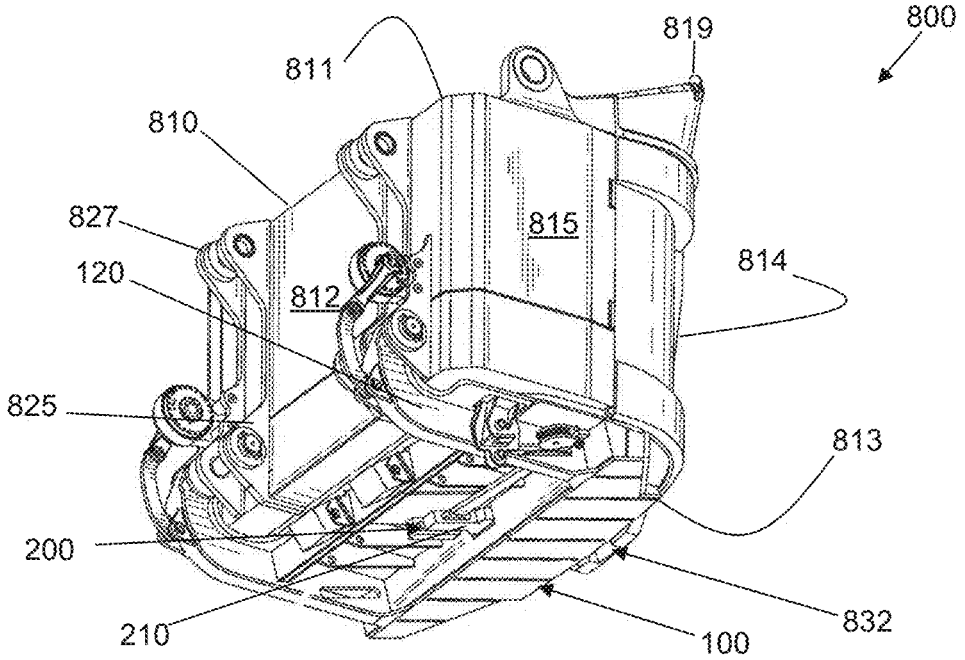
Figure 2 – Prior Art

DIPPER ASSEMBLY AND PARTS THEREOF

TECHNICAL FIELD

The present invention relates to a dipper assembly for use in the field of mining machines. In particular, the present invention concerns a dipper door latch assembly for use on a mining machine, such as, e.g., a mining shovel.

BACKGROUND

Industrial mining machines, such as, e.g., a mining shovel, draglines, etc., are used to remove earthen material from a bank of a mine. A conventional mining shovel includes a boom, a pair of handles moveably coupled to the boom, a dipper coupled to the handles, a bail that is coupled to the dipper, an equalizer that is coupled to the bail, and a hoist rope or cable that is coupled to the equalizer. The hoist rope or cable passes over a boom sheave coupled to an end of the boom, and is reeled in and paid out by a hoist drum.

During a hoist phase, the hoist cable or rope is reeled in by the hoist drum, lifting the dipper upward through a bank of earthen material and liberating the material to be dug. To release the material disposed within the dipper, a dipper door is pivotally coupled to a dipper body. When not latched to the dipper body, the dipper door pivots away from a bottom of the dipper body freeing the material via an open bottom of the dipper.

Current shovels generally use a dipper door latch mechanism including a trip wire or cable. The trip wire or cable is connected at one end to a moveable latch lever located on the dipper door with the other end adapted to be controlled by a shovel operator. The latch lever is usually coupled to a slidable latch bar that is selectively engaged in a latch keeper associated with the dipper body. The dipper door is held closed when the latch bar is engaged with the latch keeper. The dipper door is caused to open by tripping the trip wire or cable thereby moving the latch lever. Movement of the latch lever causes the latch bar to slide away and disengage from the latch keeper thereby allowing the dipper door to swing open under its own weight and the weight of the contents of the dipper.

The dipper door is generally relatched by allowing it to swing closed by virtue of its own weight and a changing approach of the dipper as it rotates back in preparation for its next hoist phase.

A problem in general with such latch mechanisms is that they are subjected to extreme abuse as the dipper cuts into banks of a mine by the action of the shovel. Consequently, the latch mechanism is prone to excessive wear resulting in machine down time and high maintenance costs while the latch mechanism is repaired and/or adjusted.

Another related problem with such latch mechanisms is that the mechanisms themselves require regular maintenance and continual adjustment to maintain acceptable operation due to excessive individual component wear separate from the wear caused by the action of the shovel as the dipper cuts into banks of a mine.

SUMMARY OF INVENTION

Embodiments of the present invention provide a dipper assembly and parts thereof, which may minimise or overcome at least one of the abovementioned problems, or which may provide the public with a useful or commercial choice.

According to a first aspect of the present invention, there is provided a dipper assembly for a mining shovel, said dipper assembly including:

- a dipper body having a back wall and an open dipper bottom;
- a dipper door pivotally coupled to the back wall for movement relative to the dipper body between a closed position in which the door closes the dipper bottom and an open position in which the door is positioned away from the dipper bottom; and
- a latch assembly for releasably securing the door in the closed position, the latch assembly including a latch keeper and a latch member for engaging the latch keeper, the latch member being coupled to the door and the latch keeper being associated with the dipper body proximate the open dipper bottom, the latch member including at least one roller to assist the latch member in engaging and disengaging the latch keeper and to at least partially reduce wear on the latch member.

According to a second aspect of the present invention, there is provided a dipper door for use with a dipper assembly of a mining shovel, said door configured to be pivotally coupled to a dipper body having an open dipper bottom for movement between a closed position in which the door closes the open dipper bottom and an open position in which the dipper door is positioned away from the open dipper bottom, said door including a latch assembly or part of a latch assembly for releasably securing the door in the closed position, the latch assembly including a latch keeper and a latch member for engaging the latch keeper, the latch member being coupled to the door and the latch keeper being associated with the dipper body proximate the open dipper bottom, the latch member including at least one roller to assist the latch member in engaging and disengaging with the latch keeper and to at least partially reduce wear on the latch member.

According to a third aspect of the present invention, there is provided a latch assembly for use with a dipper assembly of a mining shovel, said latch assembly including:

- a latch keeper configured to be associated with a dipper body proximate an open dipper bottom of the dipper body; and
- a latch member configured to be coupled to a dipper door for engaging with the latch keeper and releasably securing the dipper door in a closed position closing the open dipper bottom, said latch member including at least one roller for assisting the latch member in engaging and disengaging with the latch keeper and to at least partially reduce wear on the latch member.

Advantageously, the latch assembly of the dipper assembly and dipper door of the present invention are configured to at least partially reduce latch component wear thereby prolonging acceptable operation of the dipper assembly and reducing maintenance downtime. In particular, the at least one roller provided on the latch member advantageously assists the latch member in disengaging with the latch keeper, reduces friction between the components and thereby reduces wear.

As indicated above, the dipper assembly and parts thereof of the present invention are for use with a mining shovel.

The shovel may generally include a mobile base having drive tracks or wheels for movement along a ground surface, a turntable mounted atop the mobile base, and a revolving frame mounted atop the turntable.

The revolving frame includes a boom. The boom is couped to the dipper assembly of the present invention by way of a hoist cable extending over a boom sheave associated with an upper end of the boom and a pair of dipper handles that are slidably mounted to saddle blocks pivotally mounted to each side of the boom.

The turntable may define a rotational axis of the shovel and enable the revolving frame, including the boom, dipper handles and dipper assembly, to rotate relative to the mobile base having the drive tracks or wheels, preferably tracks.

The boom may be pivotally coupled at a lower end to the revolving frame and may extend upwardly and outwardly from the revolving frame. The boom may be held in position by tension cables extending between an upper portion of the boom and the revolving frame. The tension cables may be anchored to the revolving frame, typically via a gantry tension member and gantry compression member.

The dipper assembly may be suspended from the upper end of the boom by the hoist cable. The hoist cable may extend up the boom and over the boom sheave to connect at a first end to the dipper assembly, typically via a bail and/or equalizer. The hoist cable may be anchored at an opposite second end to a hoist drum associated with the revolving frame. The hoist drum may be driven by an electric, combustion, pneumatic or hydraulic motor, typically electric motor. The hoist cable may be paid out to lower the dipper assembly or reeled in to raise the dipper assembly.

During a hoist phase, the hoist cable may be reeled in by the hoist drum, lifting the dipper assembly upward through a bank of earthen material and liberating the material to be dug.

Each dipper handle may typically include a rack and tooth formation thereon that may engage a drive pinion mounted in each saddle block. The drive pinion may be driven by an electric, combustion, pneumatic or hydraulic motor to extend or retract each dipper handle relative to the saddle block. In use, each handle may be moveable along a saddle block to manoeuvre and position the dipper assembly.

As indicated, the dipper assembly include a dipper body and a dipper door pivotally coupled to the dipper body. The dipper door is releasably secured to the dipper body by a latch assembly enabling the door to be selectively opened to unload the earthen materials atop a desired deposit location, such as, e.g., the bucket of a dump truck.

The dipper body may be of any suitable size, shape and construction and formed form any material or materials. For example, the dipper body may be of unitary construction or formed from two or more dipper body pieces.

The dipper body may typically be formed from metal.

The dipper body may preferably have a substantially rectangular cross sectional shape. The rectangular shape may be defined by at least four walls, including the back wall.

Generally, the dipper body may include the back wall, an opposed front wall and at least a pair of opposed sidewalls extending between the back wall and the front wall.

Each wall may include an inner surface and an opposed outer surface.

Each wall may extend longitudinally between a lower edge and an opposed upper edge. The dipper body may include rounded corners extending between adjacent walls.

The dipper body may include open ends for receiving and depositing the earthen materials liberated from a bank of a mine. The open ends may include an open dipper mouth for receiving the earthen materials and the open dipper bottom located opposite the open dipper mouth and from where the earthen materials are unloaded.

The mouth and bottom may be defined by an upper rim and a lower rim extending at least partially along the upper and lower edges of the walls of the dipper body, respectively.

The upper rim may define the open dipper mouth. Likewise, the lower rim may define the open dipper bottom.

The dipper body may include a plurality of teeth or wear members extending at least partially along the upper rim to contact and engage earthen materials as the dipper assembly is moved through a hoist cycle by the action of the shovel. The plurality of teeth may preferably extend at least partially along the upper rim of the front wall of the dipper body.

The dipper door may be of any suitable size, shape and construction to cover the open dipper bottom when in the closed position. Generally, the dipper door may have a rectangular shape to cover the open dipper bottom.

Like the dipper body, the dipper door may be formed from metal.

The dipper door may include opposed surfaces, including an inner surface and an opposed outer surface. The opposed surface may be interconnected by opposing edges, including an inner edge, an opposed outer edge and opposed side edges. When the dipper door is in the closed position, the inner edge of the dipper door may abut against a lower rim of the back wall of the dipper body, the outer edge of dipper door may abut against a lower rim of the front wall of the dipper body and the opposed side edges of the dipper door may abut against the lower rims of the side walls of the dipper body.

The dipper door and/or the dipper body may include strengthening ribs or formations for imparting greater structural rigidity to the dipper assembly. For example, the dipper door may include spaced apart structural support ribs and the latch assembly of the present invention may be mounted between two of the support ribs. In some embodiments, parts of the latch assembly may extend laterally across the dipper door and may extend through an opening defined in a support rib.

As indicated above, the dipper door is pivotally coupled to the back wall of the dipper body for movement relative to the dipper body between a closed position in which the door closes the dipper bottom and an open position in which the door is positioned away from the dipper bottom. Generally, the dipper door may at least partially abut against the lower rim of the dipper body when in the closed position.

The dipper door may be pivotally coupled by any suitable way known in the art.

Typically, the dipper door includes at least a pair of L-shaped dipper door lugs. The lugs may extend from the outer surface of the dipper door past the back wall of the dipper body and may be pivotally coupled with a pivot pin to dipper door mounting lugs located on an external surface of the back wall of the dipper body.

The back wall of the dipper body may further include mounting structures for mounting the dipper assembly to the dipper handles. For example, the back wall may include protruding lugs each having a central bore therethrough, said protruding lugs configured to intermesh with corresponding lugs of the dipper handles having central bores therethrough and be pinned together by at least one pivot pin received through the central bores when co-aligned.

As indicated above, the dipper assembly includes a latch assembly for releasably securing the dipper door in the closed position.

The latch assembly includes a latch keeper associated with the dipper body and a latch member coupled to the dipper door and configured to engage with the latch keeper to releasably secure the dipper door in the closed position.

The latch keeper may be of any suitable size, shape and construction for at least partially receiving the latch member.

Generally, latch keeper may be in the form of an opening defined in the front wall of the dipper body proximate the open dipper bottom. Typically, the latch keeper may be defined at a mid-point along the lower edge portion or lower rim of the front wall of the dipper body.

The latch keeper may be integrally formed with the dipper body or may be a separate, removable and replaceable element to the dipper body, preferably the latter.

In some embodiments, the latch keeper may include an angled or sloped entry to guide and facilitate movement of the latch member, particularly the at least one roller associated with the latch member, into the opening.

In some embodiments, the latch keeper may include at least one roller disposed within the opening of the latch keeper. Again, the at least one roller may guide and facilitate movement of the latch member into the opening of the latch keeper.

The latch member may be of any suitable size, shape and construction for engaging with the latch keeper and releasably securing the dipper door in the closed position.

Typically, the latch member may be formed from metal and may have an elongate shape having a lower end and an opposed upper end. The latch member may be of tubular or solid construction, preferably the latter.

The latch member may preferably be bar-shaped having a substantially rectangular profile shape.

The latch member may include two opposed surfaces, including an outer surface and an opposed inner surface or dipper facing surface. The opposed surfaces may extend substantially parallel to one another and be interconnected by opposing edges. The opposing edges may include a pair of opposed side edges and a pair of opposed end edges.

In some embodiments, the latch member may include a flared lower end portion. The flared lower end portion may have a greater width and/or thickness than an upper end portion.

In some embodiments, the lower end of the latch member may include one or more inserts configured to engage with and facilitate movement of the latch member into the latch keeper. The inserts may be made from a durable, low friction, low wear, heat resistant and corrosion resistant material or materials, such as, e.g., plastic, including nylon, polyacetal, polytetrafluoroethylene (PTFE), ultra-high-molecular-weight polyethylene (UHMWPE), rulon, PEEK, urethane or vespel (a high-performance polyimide).

As indicated, the latch member includes at least one roller for assisting the latch member in engaging and disengaging with the latch keeper and to at least partially reduce wear on the latch member. The at least one roller may be of any suitable size, shape and construction and may be located in any suitable location on the latch member to engage with and facilitate movement of the latch member into and out of engagement with the latch keeper, preferably for disengagement.

Typically, the at least one roller may be rotatably mounted to the lower end of the latch member, preferably detachably, rotatably mounted.

In some embodiments, the roller may be a cylindrical metal pin rotatably mounted between two protruding side edge portions of the latch member. The roller may be rotatably mounted in any suitable way known in the art. For example, in some embodiments, the roller may rotate on roller journals fitted to or housed within the two protruding side edge portions.

In other embodiments, the roller may be part of a roller assembly configured to be detachably mounted to the lower end of the latch member. The roller assembly may include the roller and a pair of roller mounts coupled to each end of the roller and configured to be mounted to the lower end of the latch member so that the roller may freely rotate relative to the lower end of the latch member. The roller mounts may be detachably coupled to the roller.

The roller may again be cylindrical pin or sleeve. The pair of roller mounts may each extend from an end of the roller and may be rotatably coupled to the roller by at least one rolling bearing, for example. The pair of mounts may each preferably have a circular profile shape, including a circular sidewall extending outwardly from an end of the roller to an outer mount end.

The roller mounts may be connected to the lower end of the latch member in any suitable way.

For example, in some embodiments, the roller mounts may fastened to the lower end of the latch member by one or more mechanical fasteners (e.g., threaded fasteners) and/or a chemical fastener (e.g., adhesive).

In other embodiments, the roller mounts and the lower end of the latch member may be connectable by a connecting mechanism or part of a connecting mechanism. For example, a first part of the connecting mechanism associated with each roller mount may mate or engage with a second part of the connecting mechanism associated with the lower end of the latch member.

The connecting mechanism may include mateable male and female portions that couple together, including interference fit connections, for example. The connecting mechanism may include a male formation associated with each roller mount configured to be inserted into or coupled with a female formation associated with the lower end of the latch member. Conversely, the connecting mechanism may include a female formation associated with each roller mount configured to at least partially receive or be coupled with a male formation associated with the lower end of the latch member.

In preferred embodiments, the lower of the latch member may include a recessed portion configured to at least partially accommodate the roller assembly when connected to the lower end.

In some such embodiments, the recessed portion may be defined between two protruding side edge portions extending downward from the lower end edge.

In other such embodiments, the recessed portion may be further defined by a portion of the latch member extending between the protruding side edge portions, preferably a portion of on the inner surface side. Advantageously, the portion extending between the protruding side edge portions may, in use, at least partially shield the roller assembly from fines and other debris contained within the dipper that could otherwise clog and impede the roller from free rotation.

In some embodiments, the roller assembly may further include a shield portion for shielding the roller from fines and other debris contained within the dipper that could otherwise clog and impede the roller from free rotation. The shield may be a made from a durable, low friction, low wear, heat resistant and corrosion resistant material or materials, such as, e.g., plastic, including nylon, polyacetal, polytetrafluoroethylene (PTFE), ultra-high-molecular-weight polyethylene (UHMWPE), rulon, PEEK, urethane or vespel (a high-performance polyimide).

The shield portion may preferably be adapted to partially couple around the roller and be received in the recessed portion together with the roller assembly so as to at least partially shield the roller from fines and other debris contained within the dipper but not, in use, prevent rotation of the roller when, for example, the latch member is disengaging from the latch keeper.

In some embodiments, the protruding side edges portions may each include an opening or channel extending therethrough for at least partially receiving and holding a roller mount of the roller assembly. Each opening or channel may typically have a substantially circular shape to at least partially complement the circular profile shape of a roller mount.

Each roller mount may further include a connecting pin protruding from a circular sidewall of the roller mount. The connecting pin may be at least partially received in a corresponding hole defined in a wall of the channel or opening defined in the protruding side edge portions to further secure the roller assembly to the lower end of the latch member.

Accordingly, to connect the roller assembly to the lower end of the latch member, each roller mount may be aligned with and at least partially received in a corresponding opening or channel defined in the protruding side edge portions and connected together. If present, the connecting pin protruding from each roller mount may be aligned with and received in a corresponding hole defined in the wall of the channel or opening.

In some embodiments, a closing portion may be fastened over an entrance to each channel to close the channel and secure the roller mount within each channel. The closing portion may be affixed using any suitable fastener.

In some embodiments, more than one roller may be mounted to the lower end of the latch member.

In some embodiments, the upper end portion of the latch member may include an engagement portion to facilitate easy gripping and/or removal of the latch member from the latch assembly to repair or replace the latch member.

The engagement portion may be a recessed flange with an aperture, in some embodiments. In other embodiments, the engagement portion may be a protruding flange with an aperture.

Generally, the latch member may be slidably mounted to the outer surface of the dipper door and may extend at least partially along a height of the door from the outer edge at least partially towards the inner edge. The latch member may orthogonally extend at least partially towards the inner edge from the outer edge.

Preferably, the latch member may be slidably mounted at least partially between spaced apart structural support ribs of the dipper door. The latch member may be slidable between an extended position in which the lower end of the latch member may protrude past the outer edge for engagement with the latch keeper and a retracted position in which the latch member may at least partially slide or retract at least partially towards the inner edge to disengage the lower end of the latch member from the latch keeper.

In some embodiments, the latch member may be at least partially disposed within the dipper door. For example, the dipper door may include a latch member housing forming a channel that extends between an interior cavity of the dipper door to an external surface.

The latch member housing may be integrally formed with the dipper door or may be a separate piece. The cavity of the latch member housing may be sized and shaped to receive at least the flared lower end portion of the latch member.

In some embodiments, the latch member housing may include one or more bearings or guide surfaces, such as, e.g., plastic or nylon bearing inserts, roller bearings or other type of rollers, to facilitate sliding movement of the latch member within the latch member housing.

The dipper door may further include a retention plate configured to be fitted proximate an interior cavity entrance of the latch member housing for retaining the latch member at least partially within the latch member housing. The retention plate may typically include an aperture therethrough sized and shaped to enable an upper portion of the latch member to pass therethrough but not the lower end portion of the latch member. The retention plate may be fastened to the interior cavity entrance, by, e.g., one or more mechanical fasteners.

The latch member may be slid between the extended and retracted positions by an actuating mechanism. Any suitable type of actuating mechanism may be used. For example, movement may be linear, although non-linear movement, such as rotary movement is also envisaged.

For example, the actuating mechanism may include one or more of a lever, ram, operable handle, sliding arrangement (e.g., one or more shafts extending through one or more openings, or tongue in groove), hinged arrangement, or pivoting arrangement for sliding the latch member between the extended and retracted positions (the latter corresponding to the position for releasing the latch member from engagement with the latch keeper). In some embodiments, the actuating mechanism may include one or more biasing mechanisms so that sliding movement of the latch member into, e.g., the retracted position, works against the force of the biasing mechanism, and so that the movement of the latch member into the extended position is under the force of the biasing mechanism. The biasing member may be one or more springs, such as, e.g., coil or leaf springs, or may simply be gravity, for example. Of course, a person skilled in the art will appreciate that other types of biasing mechanism or members, such as, e.g., magnets or magnetized elements and the like, may be used.

In preferred embodiments, the latching assembly further includes a latch lever member coupled to the latch member, said latch lever member configured to pivot between raised and lowered positions and slide the latch member respectively between the retracted and extended positions.

The latch lever member may be of any suitable size, shape and construction for coupling with the latch member and, in use, pivoting between the raised and lowered positions.

Generally, the latch lever member may be formed from metal and may have an elongate shape extending between a first end pivotally mounted to the dipper door and an opposed second end pivotable between the raised and lowered positions. The latch lever member may be of tubular or solid construction, preferably the latter.

The latch lever member may also preferably be bar-shaped. The latch lever member may be of unitary construction or may be formed from two or more latch lever member pieces.

The latch lever member may preferably extend laterally across the dipper door with the second end being located at or near a side edge of the dipper door for connection with a trip wire or cable assembly or component thereof, for example.

Like the latch member, the latch lever member may include two opposed surfaces, including an outer surface and an opposed inner surface or dipper facing surface. The opposed surfaces may extend substantially parallel to one another and be interconnected by opposing edges. The opposing edges may include a pair of opposed side edges and/or a pair of opposed end edges.

In some embodiments, the opposed side edges may include one or more contours.

In some embodiments, the opposed end edges may be rounded.

The latch lever member and the latch member may be coupled together in any suitable way enabling the latch lever member to pivot between the raised and lowered positions and the latch member to slide between the retracted and extended positions.

Generally, the latch lever member may extend through an opening defined in an upper end portion of the latch member. The opening may extend entirely through the latch member between opposed side edges and be configured to receive the latch lever member therethrough.

When coupled together, the latch lever may be coupled to the latch lever member at a location proximate the first end.

In preferred embodiments, the opening may further include a wear insert configured to be disposed within an upper portion of the opening and at least partially reduce wear of the latch member and the latch lever member as they move relative to one another. The wear insert may be formed from a durable, low friction, low wear, heat resistant and corrosion resistant material or materials, such as, e.g., plastic, including nylon, polyacetal, polytetrafluoroethylene (PTFE), ultra-high-molecular-weight polyethylene (UHMWPE), rulon, PEEK, urethane or vespel (a high-performance polyimide). Preferably, the wear insert may be formed form nylon.

The wear insert may include a curved, contoured lower surface configured to substantially complement a curved, contoured upper surface of the latch lever member. The surfaces may together act as bearing surfaces to permit some rotation and relative movement in at least one degree of freedom between the insert and the latch lever member thereby inhibiting wear and unwanted stress from damaging the coupling of the latch assembly.

In some embodiments, the opening may further include a second said wear insert disposed within a lower portion of the opening. The second said wear insert may include a curved, contoured upper surface configured to substantially complement a curved, contoured lower surface of the latch lever member. Again, the surfaces may together act as bearing surfaces to permit some rotation and relative movement in at least one degree of freedom between the insert and the latch lever member thereby inhibiting wear and unwanted stress from damaging the coupling of the latch assembly.

In some embodiments, one or both of the opposed surfaces of the latch lever member may include one or more plain bearings disposed thereon. Each plain bearing may be configured to at least partially reduce wear of the latch member and the latch lever member as they move relative to one another. Each plain bearing may be a separate, removable and replaceable element to the latch lever member.

Again, the plain bearings may be preferably be formed from a durable, low friction, low wear, heat resistant and corrosion resistant material or materials, such as, e.g., plastic, including nylon, polyacetal, polytetrafluoroethylene (PTFE), ultra-high-molecular-weight polyethylene (UHMWPE), rulon, PEEK, urethane or vespel (a high-performance polyimide).

Generally, each plain bearing may be at least partially received in an opening defined in a surface of the latch lever member, preferably an opening extending entirely through the latch lever member between the opposed surfaces.

Each plain bearing may be of any suitable size, shape and construction to be at least partially received in the opening and provide a bearing surface.

Typically, each plain bearing may include a wide head having a substantially flat shape, said head configured to rest at least partially against the surface of the latch lever member and act as a bearing surface. Each plain bearing may further include a shank extending from the head and configured to be received in the opening in the latch lever member. The shank may be threaded or barbed for retaining the plain bearing in the opening, for example.

In some embodiments, a pair of opposed plain bearings may be inserted into opposite sides of the opening and the respective shanks of the bearings may be connectable to secure the bearings in place, e.g., threadingly connectable.

In preferred embodiments, the latch lever member may include at least a pair of plain bearings disposed on each of the opposed surfaces, said plain bearings providing bearing surfaces between the latch lever member and the lever member as they move relative to one another. Typically, the bearings may act as bearing surfaces against an inner side wall of the opening in the latch member through which the latch lever member extends.

The wide head of each bearing may include a socket or other tool engaging formation for receipt of a tool to turn the bearing and threadingly connect the bearing with a further bearing received in an opposite side of the opening.

The first end of the latch lever member may be pivotally mountable to the dipper door in any suitable way that allows the latch lever member to pivot about the first end and the second end to be pivotable between the raised and lowered positions. For example, the first end of the latch lever member may be directly or indirectly pivotally mountable to the dipper door, preferably indirectly.

Generally, the latch assembly further includes a housing and pin assembly configured to receive and pivotally mount the first end of the latch lever member to the dipper door.

The housing and pin assembly may include an outer housing configured to be fastened to the dipper door, a pin coupled to the outer housing, and a carrier for receiving the first end of the latch lever member, said carrier configured to be slidably mounted to the pin and at least partially received within the outer housing.

The outer housing may include an upper wall, an opposed lower wall and a pair of opposed side walls extending between side edges of the upper and lower walls. Each of the walls may include an inner surface and an opposed outer surface.

The pair of opposed sidewalls may define a passage therebetween for accommodating at least the carrier and the first end of the latch lever member The upper wall and the lower wall of the outer housing may each include a pin receiving lug extending outwardly from a common end edge away from the latch lever member. Each pin receiving lug may include a central bore for receiving the pin therethrough.

Like the outer housing, the carrier may also include an upper wall, an opposed lower wall and a pair of opposed sidewalls extending between side edges of the upper and lower walls. Again, each of the walls may include an inner surface and an opposed outer surface.

The pair of opposed sidewalls may define a passage therebetween for at least partially receiving the first end of the latch lever member.

The upper and lower walls of the carrier may also each include a pin receiving lug for slidably mounting the carrier to the pin connected to the outer housing. In such embodiments, the carrier may be slidable along the pin within the outer housing.

In some embodiments, the housing and pin assembly may further include a plurality of spacers, also known as shims, for fitting between the inner surfaces of the upper and lower walls of the outer housing and the outer surfaces of the upper and lower walls of the carrier.

Each spacer may typically have a substantially elongate and flat shape. In some embodiments, each spacer may be shaped to at least partially complement or accommodate the pin of the housing and pin assembly to retain the spacer within the assembly.

The plurality of spacers may be of uniform or differing thickness, typically the latter.

In use, spacers may be readily added and/or replaced to at least partially reduce and/or offset any wear between the outer housing and the carrier of the housing and pin assembly. Moreover, spacers may be added, replaced and/or removed to readily adjust the alignment of the latch lever member and latch member relative to one another, particularly as components of the latch assembly wear with use, thereby advantageously enabling acceptable operation of the latch assembly for a longer period of time.

The first end of the latch lever member may be pivotally coupled to the carrier in any suitable way.

For example, in some embodiments, the latch lever member may be pivotally coupled to the carrier by another connecting mechanism or part of a connecting mechanism. For example, a first part of the connecting mechanism associated with carrier may mate or engage with a second part of the connecting mechanism associated with the first end of the latch lever member.

The connecting mechanism may include mateable male and female portions that pivotally couple together, including interference fit connections, for example. The connecting mechanism may include a male formation associated with the carrier configured to be inserted into or coupled with a female formation associated with the latch lever member. Conversely, the connecting mechanism may include a female formation associated with the carrier configured to at least partially receive or be coupled with a male formation associated with the first end of the latch lever member.

Typically, the latch lever member and the carrier may be pivotally coupled together by at least one pivot pin received within co-aligned corresponding bores.

For example, in some embodiments, the first end of the latch lever member and the opposed sidewalls of the carrier may each include a central bore therethrough, and the latch lever member and the carrier may be pinned together by at least one pivot pin received through the central bores when co-aligned.

The central bore of the latch lever member and/or the central bores of the carrier may include at least one bushing disposed within the bore. The at least one bushing may be of any suitable type configured to receive at least one pivot pin. For example, the at least one bushing may be a spherical or polymer bushing. The at least one bushing may be a self-lubricating bushing or may require lubricant from an external source.

In preferred embodiments, the central bore in the first end of the latch lever member may include at least one bushing disposed within the bore, preferably a spherical, self-lubricating bushing.

The at least one pivot pin may be of any suitable construction to be received within the co-aligned bores and enable the first end of the latch lever member to rotate about the pivot pin.

The at least one pivot pin may be of unitary construction or may be constructed from two or more pivot pin pieces.

The pivot pin may be sized and shaped to be at least partially received within the bores and the bushing.

The pivot pin may be sized and shaped to at least partially prevent the bushing from moving axially in at least one direction within the central bore of the latch lever member, preferably in both directions.

The pivot pin may be sized and shaped to align and/or fix a rotation of the pin when inserted in the bores.

In some embodiments, the pivot pin may include a head, an opposed end and a shank extending from the head to the end.

The shank may be sized and shaped to be received through the central bores and an inner aperture of the at least one bushing.

The shank may be threaded or barbed for retaining the pivot pin in the central bores and an inner aperture of the bushing. For example, the shank may include a threaded outer portion at or near the end for engaging with a nut when it protrudes through the bores and the at least one bushing.

The head may be sized and shaped such that it may not pass through the bores and the inner aperture but may abut against an outer surface of a sidewall of the carrier.

Preferably, the head may be sized and shaped to align and/or fix rotation of the pin relative to the bores and the at least one bushing.

For example, in some embodiments, the head of the pivot pin may have a non-circular profile shape and the central bores through the opposed sidewalls of the carrier may likewise have a non-circular profile shape to complement the non-circular profile shape of the head of the pivot pin.

In other embodiments, the central bores of the carrier may each include a countersunk outer opening having a non-circular shape configured to complement and at least partially receive the non-circular profile shape of the head of the pivot pin.

In some embodiments, the at least one pivot pin may include a pair of pivot pins each including a head, an opposed end and a shank extending from the head to the opposed end. The pair of pivot pins may be configured to be inserted into the central bores and bushing from opposite sides and be connectable to pivotally couple the latch lever member and the carrier together.

The pair of pivot pins may be connectable in any suitable way.

For example the respective ends of the pivot pins may include mateable male and female formations configured to mate or couple together.

The respective ends of the pivot pin may threadingly engage one another.

Typically, each of the pivot pins may include a central aperture axially extending through the pivot pin and configured to receive a mechanical fastener entirely therethrough, such as, e.g., a bolt, to fasten the pair of pins together in an end-to-end arrangement.

According to a fourth aspect of the present invention, there is provided a method of releasably securing a dipper door of a mining shovel in a closed position, said method including:

providing the dipper assembly of the first aspect; and moving the dipper body of the mining shovel such that the dipper door moves towards and closes the open dipper bottom thereby bringing the latch member into engagement with the latch keeper to releasably secure the dipper door in the closed position.

The method may include one or more characteristics or features of the dipper assembly, the dipper door and/or the latch assembly as hereinbefore described.

According to a fifth aspect of the present invention, there is provided a method of releasing a dipper door of a mining shovel, said method including:

providing the dipper assembly of the first aspect; and tripping release of the latching assembly to move the latch member out of engagement with the latch keeper thereby allowing the dipper door to swing open relative to the dipper body.

The method may include one or more characteristics or features of the dipper assembly, the dipper door and/or the latch assembly as hereinbefore described.

Any of the features described herein can be combined in any combination with any one or more of the other features described herein within the scope of the invention.

The reference to any prior art in this specification is not, and should not be taken as an acknowledgement or any form of suggestion that the prior art forms part of the common general knowledge.

BRIEF DESCRIPTION OF DRAWINGS

Preferred features, embodiments and variations of the invention may be discerned from the following Detailed Description which provides sufficient information for those skilled in the art to perform the invention. The Detailed Description is not to be regarded as limiting the scope of the preceding Summary of Invention in any way. The Detailed Description will make reference to a number of drawings as follows:

FIG. 1 is a perspective view of a prior art mining shovel;

FIG. 2 is a lower perspective view of a prior art dipper assembly having a dipper body and a dipper door pivotally coupled to the dipper body;

DETAILED DESCRIPTION

Figure 3:
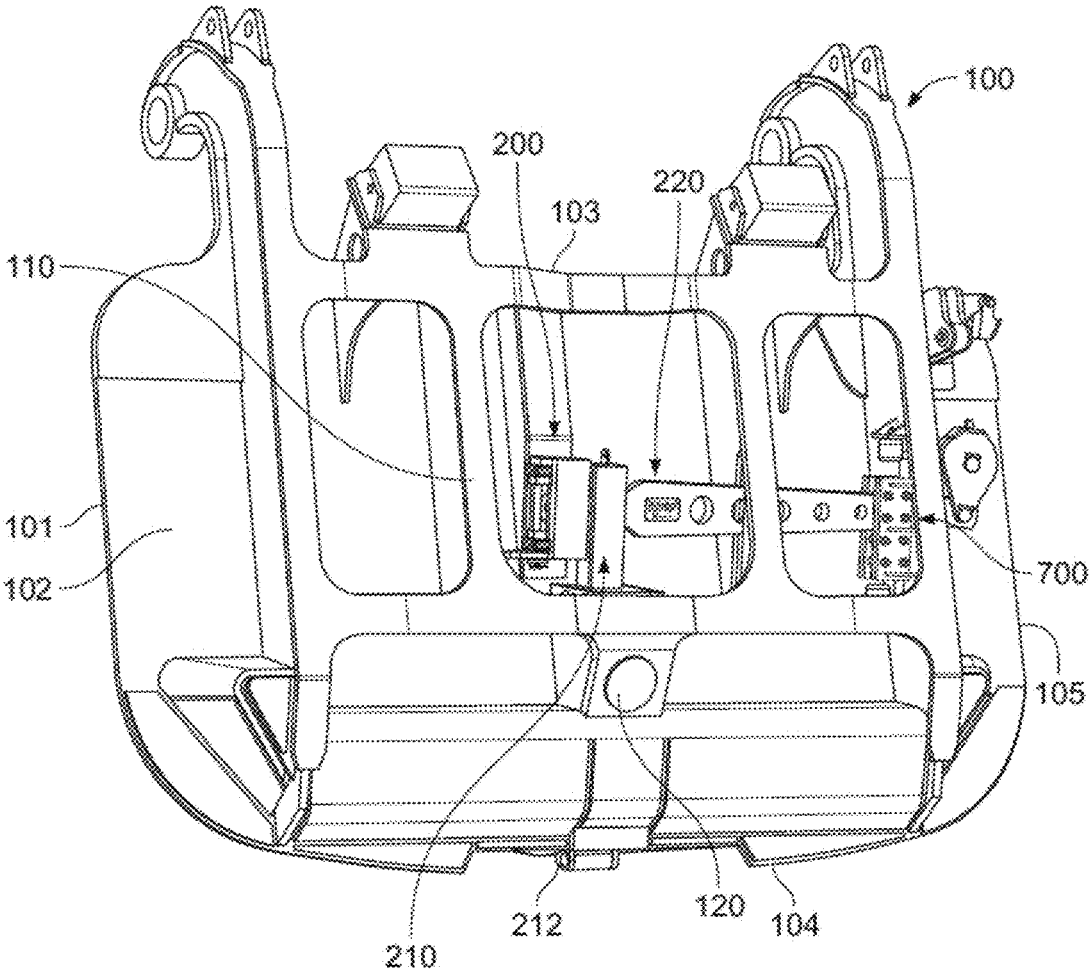
FIG. 3 is a perspective view of a dipper door and latch assembly according to an embodiment of the present invention.

FIG. 1 shows a prior art mining shovel (900). The shovel (900) includes a mobile base (910) having drive tracks (920) for movement along a ground surface, a turntable (930) mounted atop the mobile base (910), and a revolving frame (940) mounted atop the turntable (930).

The revolving frame (940) includes a boom (950). The boom (950) is coupled to a dipper assembly (800; best shown in FIG. 2) by way of a hoist cable (960) extending over a boom sheave (952) associated with an upper end of the boom (950) and a pair of dipper handles (970) that are slidably mounted to saddle blocks (980) pivotally mounted to each side of the boom (950).

The turntable (930) defines a rotational axis of the shovel (900) and enables the revolving frame (940), including the boom (950), dipper handles (970) and dipper assembly (800), to rotate relative to the mobile base (910) and drive tracks (920).

The boom (950) is pivotally coupled at a lower end to the revolving frame (940) and extends upwardly and outwardly from the revolving frame (940).

The dipper assembly (800) is suspended from the upper end of the boom (950) by the hoist cable (960). The hoist cable (960) extends up the boom (950) and over the boom sheave (952) to connect at a first end to the dipper assembly (800) via a bail (890). The hoist cable (960) is anchored at an opposite second end to a hoist drum (not visible) associated with the revolving frame (940). The hoist drum (not visible) is driven by an electric motor. The hoist cable (960), in use, is paid out or reeled in by the hoist drum (not visible) to respectively lower or raise the dipper assembly (800).

During a hoist phase, the hoist cable (960) is reeled in by the hoist drum (not visible) to lift the dipper assembly (800) upward through a bank of earthen material and liberating the material to be dug.

Each dipper handle (970) includes a rack and tooth formation thereon to engage a drive pinion mounted in each saddle block (980). The drive pinion is driven by an electric motor to extend or retract each dipper handle (970) relative to the saddle block (980). In use, each handle (970) is moveable along a respective saddle block (980) to manoeuvre and position the dipper assembly (800).

Referring to FIG. 2, the dipper assembly (800) includes a dipper body (810) and a dipper door (100) pivotally coupled to the dipper body (810). The dipper door (100) is releasably secured to the dipper body (810) by a latch assembly (200) enabling the door (100) to be selectively opened to unload earthen material contents atop a desired deposit location, such as, e.g., the bucket of a dump truck.

The dipper body (810) has a substantially rectangular cross-sectional shape defined by four walls, including the back wall (812), an opposed front wall (814), and a pair of opposed sidewalls (815) extending between the back wall (812) and the front wall (814).

Each wall (812, 814, 815) includes an inner surface and an opposed outer surface.

Each wall (812, 814, 815) extends longitudinally between a lower edge and an opposed upper edge.

The dipper body (810) includes rounded corners extending between adjacent walls (812, 814, 815).

The dipper body (810) includes open ends for receiving and depositing the earthen materials liberated from a bank of a mine. The open ends include an open dipper mouth (811) for receiving the earthen materials and an open dipper bottom (813) located opposite the open dipper mouth (811) and from where the earthen materials are unloaded.

The mouth (811) and bottom (813) are defined by an upper rim and a lower rim extending at least partially along the upper and lower edges of the walls (812, 814, 815) of the dipper body (810), respectively.

The upper rim defines the open dipper mouth (811). Likewise, the lower rim defines the open dipper bottom (813).

The dipper body (810) includes a plurality of teeth (819; best shown in FIG. 1) extending along the upper rim of the front wall (814) of the dipper assembly (800) to contact and engage earthen materials as the dipper assembly (800) is moved through a hoist cycle by the action of the shovel (900; shown in FIG. 1 only).

As mentioned, the dipper door (100) is pivotally coupled to the back wall (812) of the dipper body (810) for movement relative to the dipper body (810) between a closed position in which the door (100) closes the dipper bottom (813) and an open position in which the door (100) is positioned away from the dipper bottom (813).

The dipper door (100) includes a pair of L-shaped dipper door lugs (120). The lugs (120) extend from the dipper door (100) past the back wall (812) of the dipper body (810) and are pivotally coupled with a pivot pin to dipper door mounting lugs (825) located on an outer surface of the back wall (812) of the dipper body (810).

As shown, the back wall (812) of the dipper body (810) includes further protruding lugs (827) for mounting the dipper assembly (800) to the dipper handles (970; shown only in FIG. 1).

The dipper assembly (800) includes a latch assembly (200) for releasably securing the dipper door (100) in the closed position. The latch assembly (200) includes a latch keeper (832) associated with the dipper body (810) and a latch member (210) coupled to the dipper door (100) and configured to engage with the latch keeper (832) to releasably secure the dipper door (100) in the closed position as shown.

The latch member (210) of the assembly (200) is moveable between an extended position in which the dipper door (100) is secured in the closed position and a retracted position in which the dipper door (100) is able to move to the open position.

The latch member (210) is biased into the extended position by a biasing member or mechanism associated with a trip wire or cable assembly (not shown). Tripping of the trip wire or cable assembly by a shovel operator causes the latch member (210) to temporarily move to the retracted position against the force of the biasing member or mechanism before the latch member (210) is biased back into the extended position under the force of the biasing member or mechanism in preparation for re-latching of the dipper door (100).

The latch keeper (832) is in the form of an opening defined in the front wall (812) of the dipper body (810) proximate the open dipper bottom (813). The latch keeper (832) is defined mid-way along the lower rim of the front wall (812) of the dipper body (810).

Referring to FIG. 3, the dipper door (100) is of a size, shape and construction to cover the open dipper bottom when in the closed position.

The dipper door (100) is formed from metal.

The dipper door (100) has a substantially rectangular shape and includes an inner surface (101) and an opposed outer surface (102). The inner and outer surfaces (101, 102) are interconnected by opposing edges, including an outer edge (104) configured to abut the lower rim of the front wall of the dipper body, an opposed inner edge (103) configured to abut the lower rim of the back wall of the dipper body and opposed side edges (105).

The dipper door (100) includes structural support ribs (110) for imparting greater structural rigidity to the dipper door (100). As shown, the structural support ribs (110) are spaced apart across the outer surface (102) of the door (100) and the latch assembly (200) is partially mounted between two of the support ribs (110).

The latch assembly (200) includes the latch member (210) and a latch lever member (220).

The latch member (210) is slidably mounted to the outer surface (102) of the dipper door (100) to engage with a latch keeper associated with the dipper body to releasably secure the dipper door (100) in the closed position. The latch member (210) longitudinally extends at least partially across the dipper door (100) from the outer edge (104) at least partially towards the inner edge (103) in a direction substantially perpendicular to the inner and outer edges (103, 104).

Figure 7:
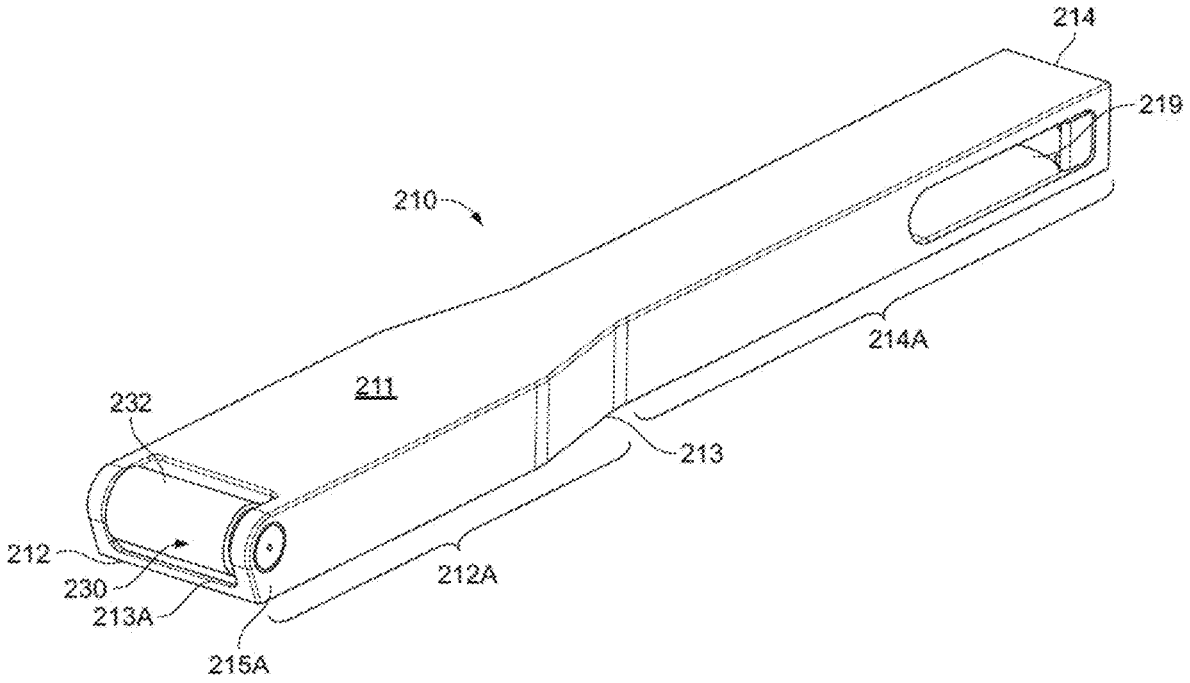
FIG. 7 is a perspective view of a latch member of the latch assembly as shown in FIGS. 3 to 6.

Referring briefly now to FIG. 7, the latch member (210) is formed from metal and has an elongate shape having a lower end (212) and an opposed upper end (214). The latch member (210) is bar-shaped and of solid construction having a substantially rectangular profile shape.

The latch member (210) includes two opposed surfaces, including an outer surface (211) and an opposed inner surface (213) configured to face the dipper door (100; not shown). The opposed surfaces (211, 213) extend substantially parallel to one another and are interconnected by opposing edges, including a pair of opposed side edges and a pair of opposed end edges.

The latch member (210) includes an opening (219) in an upper end portion (214A) for receiving the latch lever member (220) therethrough. The opening (210) extends entirely through the latch member (210) forming a channel extending between the opposed side edges.

The latch member (210) includes a flared lower end portion (212A). The flared lower end portion (212A) has a greater width and/or thickness than the upper end portion (214A).

The lower end (212) of the latch member (210) includes recessed portion defined by two protruding side edge portions (215A) for at least partially accommodating a roller assembly (230), including a shield portion (213A).

The roller assembly (230) is for assisting the latch member (210) in disengaging with a latch keeper and to at least partially reduce wear on the latch member (210).

Advantageously, the shield portion (213A), in use, at least partially shields the roller assembly (230) from fines and other debris contained within the dipper that could otherwise clod and impede a roller (232) of the roller assembly (230) from free rotation.

Each protruding side edge portion (215A) includes an opening extending therethrough for receiving and holding the roller assembly (230).

Figure 8A:
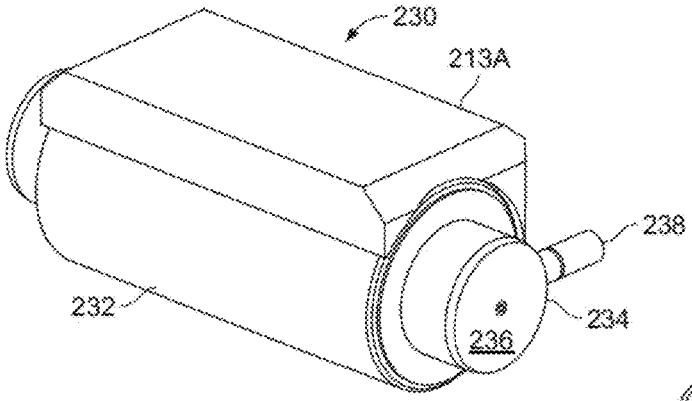
FIGS. 8A and 8B are perspective views of a roller located at an end of the latch member shown in FIG. 7.
Figure 8B:
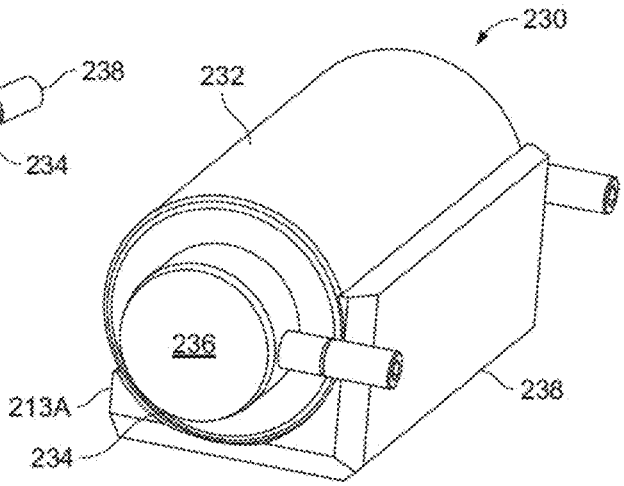

Referring to FIGS. 8A and 8B, the roller assembly (230) includes the roller (232) in the form of a cylindrical metal pin or sleeve, and a pair of roller mounts (234) rotatably coupled to each end of the roller (232) and configured to be received within the channels of the protruding side edge portions so that the roller (232) can freely rotate.

The roller assembly (230) further includes the shield portion (213A), which is formed from plastic and is adapted to partially couple around the roller (232) so as to at least partially shield the roller (232) from fines and other debris contained within the dipper but not, in use, prevent rotation of the roller (232) when, e.g., the latch member is disengaging from the latch keeper. The shield portion (213A) is a separate, removable and replaceable element.

The pair of roller mounts (234) each have a circular profile shape, including a circular sidewall extending outwardly from an end of the roller (232) to an outer mount end (236). Each mount (234) further includes a connecting pin (238) protruding outwardly from the circular sidewall and configured to be received within a corresponding hole defined in a wall of each opening of the protruding side edge portions.

Referring back to FIG. 3, the latch member (210) is partially disposed within the dipper door (100). The dipper door (100) includes a latch member housing (120) forming a channel that extends between an interior of the dipper door (100) to an external surface.

The cavity of the latch member housing (120) is sized and shaped to receive the flared lower end portion (212A; not visible) of the latch member (210) therethrough and enable the lower end (212) to protrude past an external exit of the channel for engagement with a latch keeper.

The latch lever member (220) is coupled to the latch member (210) and is pivotable between lowered and raised positions to respectively slide the latch member (210) between an extended position in which the lower end (212) of the latch member (210) extends past the outer edge (104) of the dipper door (100) for engagement with a latch keeper associated with the dipper body and a retracted position in which the lower end (212) of the latch member (210) at least partially retracts for disengagement from the latch keeper.

The latch lever member (220) has an elongate shape extending between a first end (222; not visible) pivotally mounted to the dipper door (100) and an opposed second end (224; not visible) pivotable between the lowered and raised positions.

As shown, the latch lever member (220) extends laterally across the dipper door (100) with the second end (224; not visible) being located at or near a side edge (105) of the dipper door (100) for connection with a trip wire or cable assembly (700) or component thereof.

Figure 9:
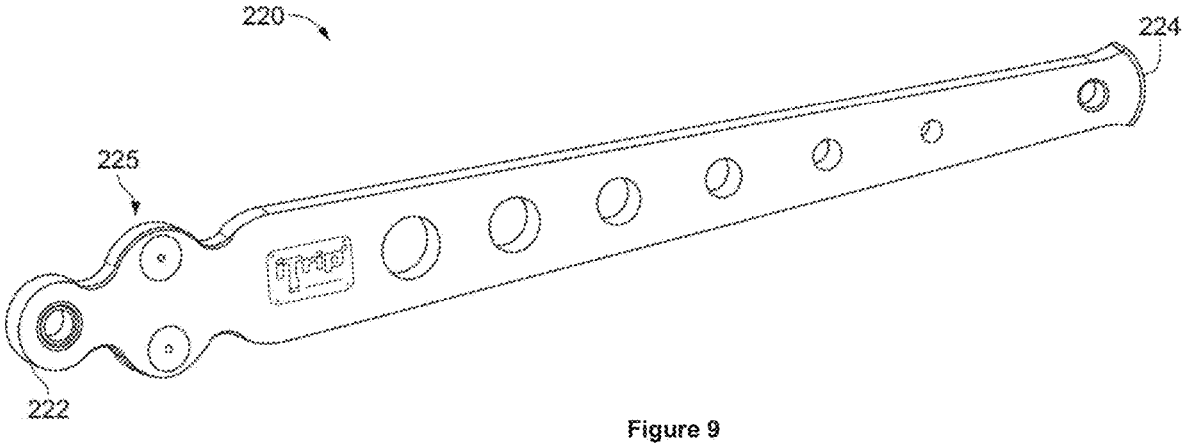
FIG. 9 is a perspective view of a latch lever member of the latch assembly as shown in FIGS. 3 to 6.

Referring briefly to FIG. 9, the latch lever member (220) is formed from metal and is bar-shaped. The latch lever member (220) is of solid construction.

The latch lever member (220) include two opposed surfaces, including an outer surface and an opposed inner surface or dipper door facing surface. The opposed surfaces extend substantially parallel to one another and are interconnected by opposing edges. The opposing edges include a pair of opposed side edges and/or a pair of opposed end edges.

The opposed side edges include one or more contours and the opposed end edges are rounded.

Figure 10A:
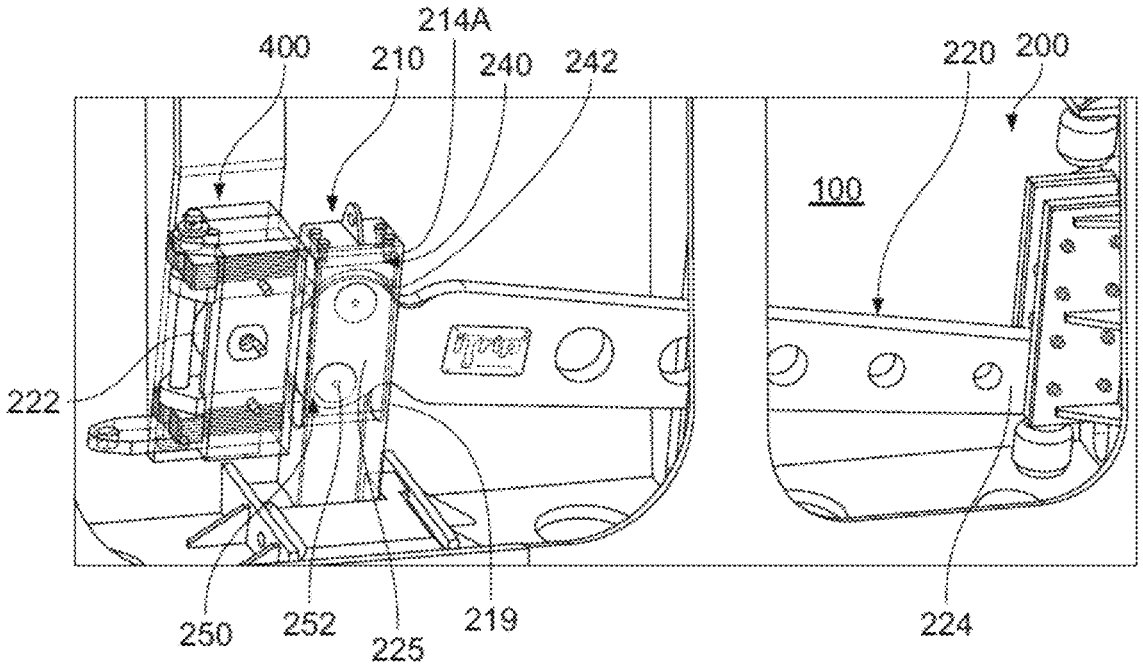
FIGS. 10A and 10B respectively show sectional views of the latch member of the latch assembly as shown in FIGS. 4 to 6 in an extended position and in a retracted position.
Figure 10B:
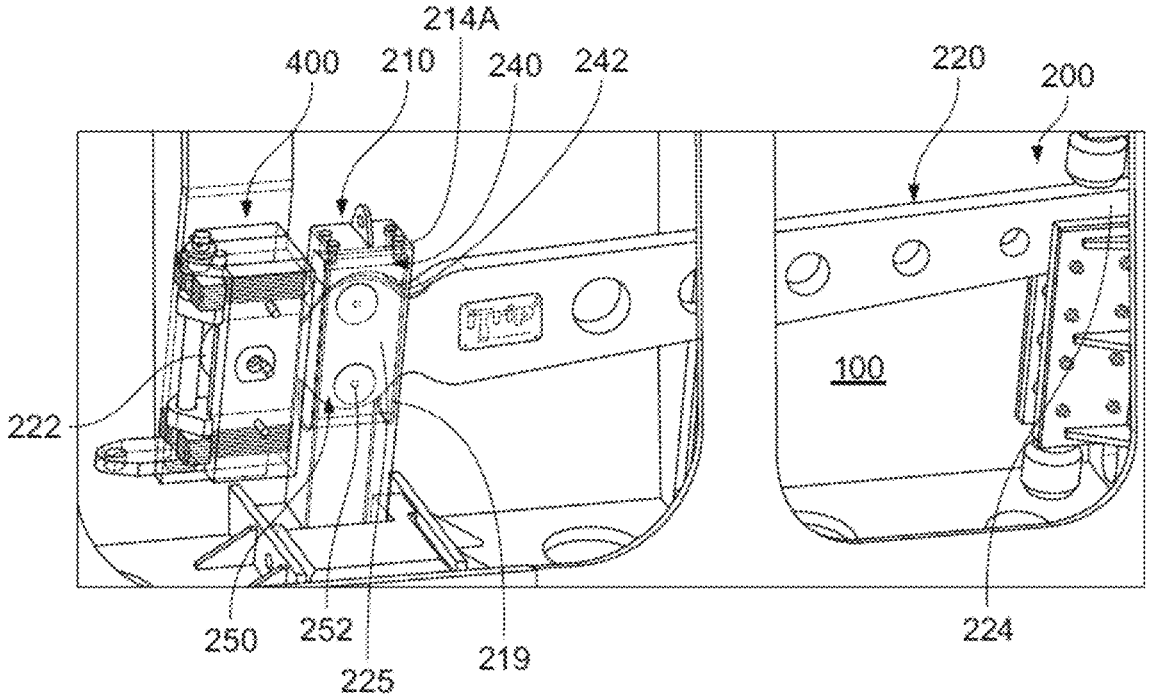

Referring to FIGS. 10A and 10B, the latch lever member (220) and the latch member (210) are coupled together such that the first end (222) of the latch lever member (220) is received through the opening (219) defined in the upper end portion (214A) of the latch member (210) and is pivotally mounted to the dipper door (100) via a housing and pin assembly (400).

The latch lever member (220) includes a curved portion (225; also shown in FIG. 9) proximate to the first end (222) that is received and located within the opening (219) of the latch member (210) when the members (210, 220) are coupled together.

In this regard, the opening (219) of the latch member (210) further includes a wear insert (240) configured to be disposed within an upper portion of the opening (219) to at least partially reduce wear of the latch member (210) and the latch lever member (220) as they move relative to one another.

The wear insert (240) is formed from nylon and includes a curved, contoured lower surface (242) configured to complement the curved portion (225) of the latch lever member (220). The surfaces act together as bearing surfaces to permit some rotation and relative movement in at least one degree of freedom between the insert (240) and the latch lever member (220) thereby inhibiting wear and unwanted stress from damaging the coupling of the latch assembly (200).

The opposed surfaces of the latch lever member (220) each also include a pair of plain bearings (250) disposed thereon. The plain bearings (250) providing bearing surfaces between the latch lever member (220) and the lever member (210) as they move relative to one another. The bearings (250) act as bearing surfaces against an inner side wall of the opening (219) in the lever member (210) through which the latch lever member (220) extends.

Each plain bearing (250) is a separate, removable and replaceable element to the latch lever member (220).

The plain bearings (250) are formed from a durable, low friction, low wear, heat resistant and corrosion resistant material or materials, such as, e.g., plastic, including nylon, polyacetal, polytetrafluoroethylene (PTFE), ultra-high-molecular-weight polyethylene (UHMWPE), rulon, PEEK, urethane or vespel (a high-performance polyimide).

Each plain bearing (250) includes a wide head having a substantially flat shape configured to rest against the surface of the latch lever member (220) and act as a bearing surface. Each plain bearing (250) further includes a shank (not shown) extending from the head and configured to be received in a corresponding opening in the lever member (220).

The plain bearing (250) are fitted in pairs on opposite sides of the latch lever member (220). Each bearing (250) of a pair is inserted into opposite sides of the same corresponding opening and the shanks are connectable to secure the bearings in place, e.g., threadingly connectable.

The wide head of each bearing (250) includes a socket or other tool engaging formation (252) for receipt of a tool to turn the bearing (250) and threadingly connect the bearing (250) with a paired bearing (250) received in an opposite side of the opening.

Figure 4:
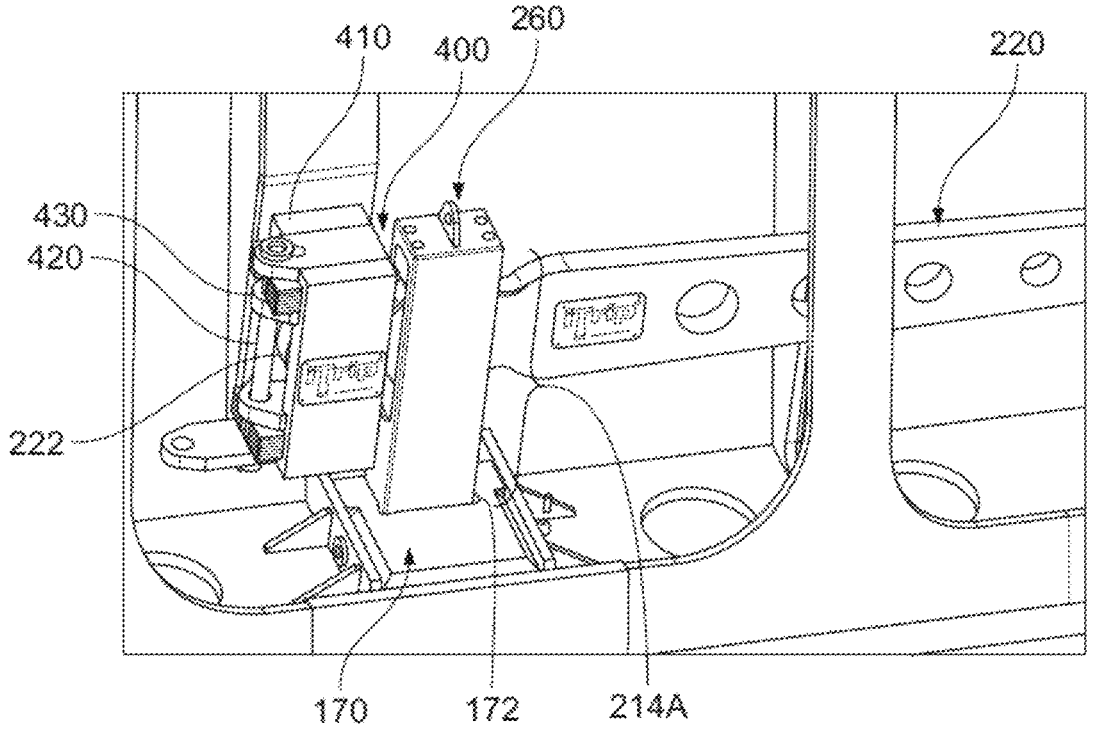
FIG. 4 is an expanded view of part of the latch assembly shown in FIG. 3.

Referring to FIG. 4, the housing and pin assembly (400) is configured to receive and pivotally mount the first end (222) of the latch lever member (220).

The housing and pin assembly (400) includes an outer housing (410) configured to be fastened to the dipper door (100), a pin (420) coupled to the outer housing (410), and a carrier (430) for receiving the first end (222) of the latch lever member (220). The carrier (430) is configured to be slidably mounted to the pin (420) and be received within the outer housing (410).

Figure 5:
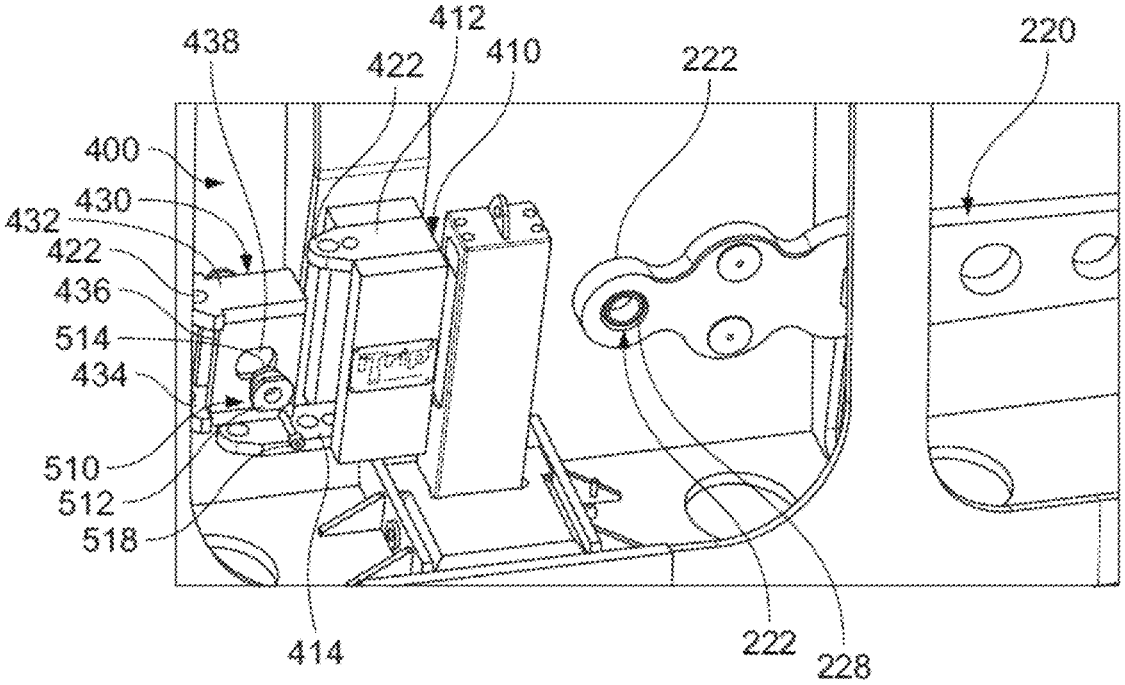
FIG. 5 is an exploded view of the part of the latch assembly shown in FIG. 4.

Referring to FIG. 5, the outer housing (410) include an upper wall (412), an opposed lower wall (414) and a pair of opposed side walls (416) extending between side edges of the upper and lower walls (412, 414). Each of the walls (412, 414, 416) includes an inner surface and an opposed outer surface.

The pair of opposed sidewalls (416) define a passage therebetween for accommodating the carrier (430) and the first end (222) of the latch lever member (220).

The upper wall (412) and the lower wall (414) of the outer housing (410) each include a pin receiving lug (422) extending outwardly from a common end edge away from the latch lever member (220). Each pin receiving lug (422) includes a central bore therethrough for receiving the pin (420; not shown).

The carrier (430) also includes an upper wall (432), an opposed lower wall (434) and a pair of opposed sidewalls (436) extending between side edges of the upper and lower walls (432, 434). Again, each of the walls (432, 434, 436) includes an inner surface and an opposed outer surface.

The pair of opposed sidewalls (436) defines a passage therebetween for receiving the first end (222) of the latch lever member (220).

The upper and lower walls (432, 434) of the carrier (430) each includes a pin receiving lug (422) for slidably mounting the carrier (430) to the pin (420; not shown) connected to the outer housing (410). The carrier (430) is slidable along the pin (420; not shown) within the outer housing (410).

Figure 6:
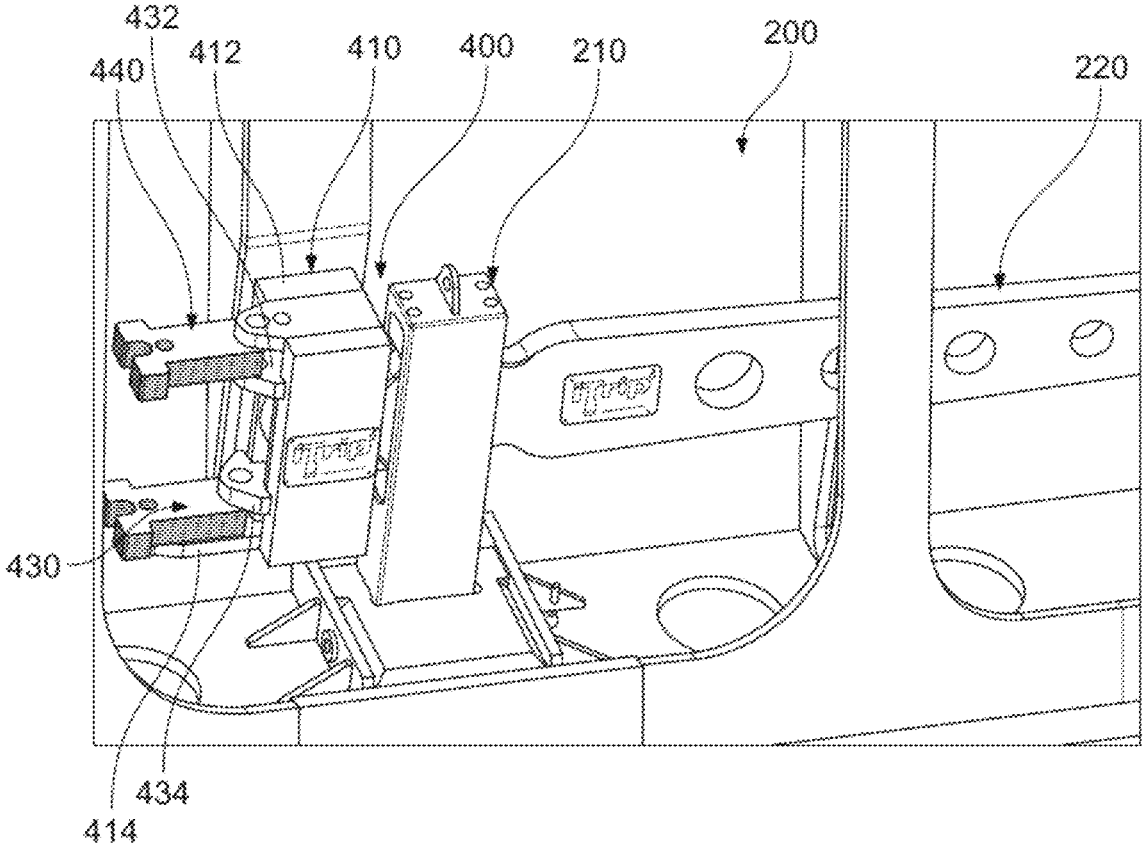
FIG. 6 is another semi-exploded view of the part of the latch assembly shown in FIG. 4.

Referring to FIG. 6, the housing and pin assembly (400) further includes a plurality of shims (i.e., spacers; 440), for fitting between the inner surfaces of the upper and lower walls (412, 414) of the outer housing (410) and the outer surfaces of the upper and lower walls (432, 434) of the carrier (430).

Each shim has a substantially elongate and flat shape and at least partially complements or accommodates the pin (420) of the housing and pin assembly (400) to, in use, assist in retaining the shim (440) within the assembly (400).

The plurality of shims (440) are of differing thicknesses.

In use, the shims (440) can be added and/or replaced to at least partially reduce and/or offset any wear between the outer housing (410) and the carrier (430) of the housing and pin assembly (400). Moreover, the shims (440) can be added, replaced and/or removed to readily adjust an alignment of the latch lever member (220) and latch member (210) relative to one another, particularly as components of the latch assembly (200) wear with use, thereby advantageously enabling prolonged acceptable operation of the latch assembly (200).

Referring again to FIG. 5, the first end (222) of the latch lever member (220) and the carrier (430) are pivotally coupled together by a pair of pivot pins (510) received within co-aligned corresponding bores (226, 438) defined in the first end (222) and the sidewalls (436) of the carrier (430).

The central bore (226) of the latch lever member (220) includes a self-lubricating spherical bushing (228) disposed within the bore (226).

Each of the pair of pivot pins (510) includes a head (512), an opposed end (514) and a shank extending therebetween.

The shank of each pin (510) is sized and shaped to be received through the central bores (226, 438) and an inner aperture of the bushing (228).

The head (512) of each pin (510) is sized and shaped to not pass through the bores (226, 438) and the inner aperture but abut against an outer surface of a sidewall (436) of the carrier (430) and thereby prevent the bushing (228) from moving axially within the central bore (226).

The head (512) of each pin (510) also has a non-circular shape to align and/or fix rotation of the pin (510) relative to the bores (226, 438) and the bushing (228).

In particular, the central bores (438) of the carrier (430) each include a countersunk outer opening having a non-circular shape configured to complement and at least partially receive the non-circular profile shape of the head (512) of a pivot pin (510)

Each of the pair of pivot pins (510) includes a central aperture axially extending entirely therethrough configured to receive a mechanical fastener (518) to fasten the pins (510) together in an end (514) to end (514) arrangement.

Referring to FIG. 4, the upper end (214) of the latch member (210) include an engagement portion (260) to facilitate easy gripping and/or removal of the latch member (210) from the latch assembly (200) to repair or replace the latch member (210).

The engagement portion (260) includes a protruding flange with an aperture therethrough.

Also shown in FIG. 4, the dipper door (100) includes a retention plate (170) configured to be fitted over an entrance to the latch member housing (120) for retaining or at least partially preventing the latch member (210) from overly retracting into the dipper door (100).

The retention plate (170) includes an aperture (172) therethrough sized and shaped to enable an upper end portion (214A) of the latch member (210) to pass through but not the flared lower end portion (212A; not visible) of the latch member (210). The retention plate (170) is fastened over the entrance, by, e.g., one or more mechanical fasteners.

Movement of the latch member (210) between the extended and retracted positions will now be described in detail with reference to FIGS. 10A and 10B.

FIG. 10A shows the latch member (210) of the latch assembly (200) in the extended position. In this position, the dipper door (100) is latched in the closed position across the open dipper bottom of the dipper body, which likely contains a load of earthen materials.

When a mining shovel operator has positioned the dipper assembly over a desired deposit location, the operator trips the trip wire or cable assembly, which is coupled to the second end (224) of the latch lever member (220), and temporarily forces the second end (224) of the latch lever member (220) to the raised position.

Movement of the second end (224) of the latch lever member (220) to the raised position causes the latch lever member (220) to pivot about the first end (222) and the curved portion (225) to move upwards in the opening (219) of the latch member (210) against the wear insert (240) and thereby slide the latch member (210) into the retracted position as shown in FIG. 10B.

Movement of the latch member (210) into the retracted position disengages the lower end (212; not shown) from a latch keeper associated with the dipper body allowing the dipper door (100) to pivot into the open position and deposit the earthen materials atop the desired deposit location.

A biasing member or mechanism associated with the trip wire or cable assembly biases the latch member (210) back into the extended position for relatching of the dipper door (100) with the dipper body by moving the second end (224) of the latch lever member (220) into the lowered position.

Movement of the second end (224) of the latch lever member (220) to the lowered position causes the latch lever member (220) to pivot about the first end (222) and the curved portion (225) to move downwards in the opening (119) of the latch member (210) and slide the latch member (210) back into the extended position for relatching with a latch keeper associated with the dipper body as shown in FIG. 10A.

In the present specification and claims (if any), the word 'comprising' and its derivatives including 'comprises' and 'comprise' include each of the stated integers but does not exclude the inclusion of one or more further integers.

Reference throughout this specification to 'one embodiment' or 'an embodiment' means that a particular feature, structure, or characteristic described in connection with the embodiment is included in at least one embodiment of the present invention. Thus, the appearance of the phrases 'in one embodiment' or 'in an embodiment' in various places throughout this specification are not necessarily all referring to the same embodiment. Furthermore, the particular features, structures, or characteristics may be combined in any suitable manner in one or more combinations.

In compliance with the statute, the invention has been described in language more or less specific to structural or methodical features. It is to be understood that the invention is not limited to specific features shown or described since the means herein described comprises preferred forms of putting the invention into effect. The invention is, therefore, claimed in any of its forms or modifications within the proper scope of the appended claims (if any) appropriately interpreted by those skilled in the art.

The invention claimed is:

1. A latch assembly for use with a dipper assembly of a mining shovel, the latch assembly comprising:

(a) a latch keeper configured to be associated with a dipper body proximate an open dipper bottom of the dipper body;

(b) a latch member configured to be coupled to a dipper door for engaging with the latch keeper and releasably securing the dipper door in a closed position closing the open dipper bottom, the latch member comprising:

(i) an outer surface;

(ii) an opposed inner surface configured to face the dipper door;

(iii) a pair of opposed side edges;

(iv) an upper end edge;

(v) an opposed lower end edge; and (vi) a recessed portion defined in the lower end edge, the recessed portion defined between two opposed side edge portions protruding downwardly from the lower end edge;

(c) a roller assembly mountable within and at least partially accommodated by the recessed portion of the latch member, the roller assembly comprising at least one roller configured to assist the latch member in disengaging with the latch keeper and to at least partially reduce wear on the latch member; and (d) a shield portion adapted to be received in the recessed portion together with the roller assembly, the shield portion configured to be partially coupled around the at least one roller of the roller assembly and extend between the opposed side edge portions and extend down from the lower end edge of the inner surface of the latch member so as to at least partially shield the roller assembly from fines and other debris from the dipper body from clogging the at least one roller and preventing rotation of the at least one roller when the latch member is disengaging from the latch keeper.

2. The latch assembly of claim 1, wherein the at least one roller is a cylindrical metal pin rotatably mounted between the two side edge portions.

3. The latch assembly of claim 1, wherein the at least one roller rotates on roller journals fitted to or housed within the two side edge portions.

4. The latch assembly of claim 1, wherein the roller assembly is detachably mounted to the latch member.

5. The latch assembly of claim 1, wherein the roller assembly further comprises a pair of roller mounts coupled to each end of the at least one roller and configured to be mounted to the two side edge portions of the latch member so that the at least one roller can freely rotate relative to the lower end of the latch member.

6. The latch assembly of claim 5, wherein the side edge portions each comprise an opening extending therethrough for at least partially receiving and holding one of the roller mounts of the roller assembly.

7. The latch assembly of claim 5, wherein each roller mount further comprises a connecting pin protruding from a circular sidewall of the mount and configured to be received in a corresponding hole defined in the opening to further secure the roller assembly to the recessed portion of the latch member.

8. The latch assembly of claim 1, further comprising a latch lever member coupled to the latch member and configured to pivot between raised and lowered positions to slide the latch member between a retracted position in which the latch member disengages from the latch keeper and an extended position in which the latch member is able to engage with the latch keeper.

9. The latch assembly of claim 8, wherein the latch lever member comprises a pair of opposed surfaces comprising an outer surface and an opposed inner or dipper facing surface, the opposed surfaces interconnected by opposing edges, the latch lever member extending longitudinally between opposed ends comprising a first end pivotally mounted to the dipper door and an opposed second end pivotable between the raised and lowered positions.

10. The latch assembly of claim 9, wherein the latch lever member extends through an opening defined in an upper end portion of the latch member and is coupled to the latch member at a location proximate the first end of the latch lever member.

11. The latch assembly of claim 10, wherein the location of the latch lever member coupled to the latch member comprises a curved, contoured upper surface.

12. The latch assembly of claim 11, wherein the opening defined in the upper end portion of the latch member further comprises a wear insert configured to be disposed within an upper portion of the opening to at least partially reduce wear of the latch member and latch lever member as they move relative to one another, and wherein the wear insert comprises a curved, contoured lower surface configured to substantially complement the curved contoured upper surface of the latch lever member.

13. The latch assembly of claim 12, wherein the latch lever member comprises one or more plain bearings disposed on the opposed surfaces to provide a bearing surface between the latch lever member and the latch member as they move relative to one another.

14. The latch assembly of claim 13, wherein the one or more plain bearings act as bearing surfaces against an inner side wall of the opening in the latch member through which the latch lever member extends.

15. The latch assembly of claim 9, further comprising a housing and pin assembly configured to receive and pivotally mount the first end of the latch lever member to the dipper door.

16. A dipper door for use with a dipper assembly of a mining shovel comprising the latch assembly of claim 1 for releasably securing the door in the closed position, wherein the door is configured to be pivotally coupled to a dipper body comprising an open dipper bottom for movement between a closed position in which the door closes the open dipper bottom and an open position in which the dipper door is positioned away from the open dipper bottom.

17. A dipper assembly for a mining shovel, the dipper assembly comprising:

(a) a dipper body comprising a back wall and an open dipper bottom;

(b) a dipper door pivotally coupled to the back wall for movement relative to the dipper body between a closed position in which the door closes the dipper bottom and an open position in which the door is positioned away from the dipper bottom; and (c) the latch assembly as defined in claim 1 for releasably securing the door in the closed position.

* * * * *